US006721527B2

(12) United States Patent
Kanari et al.

(10) Patent No.: US 6,721,527 B2
(45) Date of Patent: Apr. 13, 2004

(54) DEVELOPING APPARATUS INCLUDING A DEVELOPER COMPRESSION-AVOIDANCE FEATURE AND IMAGE FORMING APPARATUS USING SAME

(75) Inventors: Kenji Kanari, Shizuoka (JP); Yuzuru Tsurumi, Shizuoka (JP); Ken Nakagawa, Shizuoka (JP); Takeshi Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/192,647

(22) Filed: Jul. 11, 2002

(65) Prior Publication Data

US 2003/0012589 A1 Jan. 16, 2003

(30) Foreign Application Priority Data

Jul. 13, 2001 (JP) ..... 2001-214042

(51) Int. Cl.[7] ..... G03G 15/08

(52) U.S. Cl. ..... 399/281; 399/284

(58) Field of Search ..... 399/267, 279, 399/272–274, 281, 283, 284

(56) References Cited

U.S. PATENT DOCUMENTS 6,308,037 B1 * 10/2001 Yamashita ..... 399/272
6,567,630 B1 * 5/2003 Yamashita ..... 399/93

* cited by examiner

*Primary Examiner*—William J. Royer
(74) *Attorney, Agent, or Firm*—Fitzpatrick, Cella, Harper & Scinto

(57) ABSTRACT

The developing apparatus has a housing, a developer bearing member rotatably provided at an opening of the housing, a developer containing room, a carrying member for carrying developer from the developer containing room toward the developer bearing member, and a developer accumulating portion provided proximate to the developer bearing member and adapted to accumulate the developer carried by the carrying member. In the developing apparatus, the developer accumulating portion is provided above a rotational center of the carrying member.

13 Claims, 13 Drawing Sheets

FIG. 10

| RELATION BETWEEN PRINT NUMBER OF SHEETS AND OCCURENCE OF STREAK IN HH ENVIRONMENT | | | | | |
|---|---|---|---|---|---|
| NUMBER OF SHEETS (SHEETS) | | 100 | 500 | 1000 | 3000 |
| THIRD EMBODIMENT | HALFTONE | ○ | △ | △ | × |
| | CHARACTER | ○ | ○ | ○ | △ |
| FIFTH EMBODIMENT | HALFTONE | ○ | ○ | ○ | △ |
| | CHARACTER | ○ | ○ | ○ | ○ |

TONER COHESION DEGREE AND IMAGE DENSITY

DEVELOPING APPARATUS INCLUDING A DEVELOPER COMPRESSION-AVOIDANCE FEATURE AND IMAGE FORMING APPARATUS USING SAME

BACKGROUND OF THE INVENTION

1. Field of the Invention

The present invention relates to an image forming apparatus, such as a copying machine or a printer, using an electrophotographic or electrostatic recording system and to a developing apparatus to be used in the image forming apparatus.

2. Related Art

Nowadays, an increase in speed, a reduction in size, an improvement in image quality, and an increase in service life are required of image forming apparatuses. In addition, with the development of the information technology, there is an increasing demand for color image output.

An example of a technique for meeting the demand for an increase in speed is a tandem type image forming apparatus in which developing apparatuses for four colors are arranged laterally or longitudinally. Despite the fact that a plurality of developing apparatuses are arranged, no increase in apparatus size is involved since each developing unit is thin. FIG. 13 shows an example of such an image forming apparatus.

FIG. 13 is a side sectional view showing the inner construction of a tandem type printer. As shown in the drawing, a sheet conveying belt 111 is arranged substantially at the center of the interior of the apparatus. The belt 111, whose end portions are held by a driving roller 112 and a driven roller 113, circulates counterclockwise as indicated by an arrow A. On top of the belt 111, there are arranged four photosensitive drums 114 (114*a*, 114*b*, 114*c*, and 114*d*) in a sheet conveying direction (from the right to the left in the drawing).

On the upstream side of the belt 111 with respect to the sheet conveying direction, there is provided a registration roller pair 124 for correcting skew feeding of a sheet being fed. On the upstream side thereof, a sheet guiding path 125 is provided, and on the upstream side thereof, a sheet feeding roller 126 is provided. A sheet cassette 104 is arranged on the upstream side of the sheet feeding roller 126.

(Description of a Process Cartridge in an Image Forming Apparatus)

FIG. 14 is an enlarged sectional view of a process cartridge 134 to be mounted in the printer of FIG. 13. The process cartridge 134 is obtained by forming two sub units: a drum unit 135 and a developing unit 136 into an integral unit. The drum unit 135 is equipped with the photosensitive drum 114 mentioned above, a cleaner 115 arranged on the left-hand side thereof, and a charging roller 116 arranged above and on the left-hand side of the photosensitive drum 114. Light in accordance with image information emitted from a scanner 117 mounted in the printer main body impinges upon the photosensitive drum 114 at a position indicated by reference numeral 137.

The photosensitive drum 114 consists of a conductive metal roller whose surface is uniformly coated with a photoconductive material; the metal roller portion is grounded, and rotates clockwise as indicated by an arrow C.

The charging roller 116 is connected to a high-voltage power source and applies a blank-state charged potential (initialization potential applied uniformly; in a system it is applied in positive polarity, in another in negative polarity) to the photosensitive drum 114, whereby the photosensitive layer on the peripheral surface of the photosensitive drum 114 is uniformly charged, for example, in negative high potential and initialized.

The scanner 117 is equipped with a laser light source or an LED light source, and performs selective exposure in accordance with image information on the peripheral surface of the photosensitive drum 114 charged in negative high potential. As a result of this exposure, there is formed on the surface of the photosensitive drum 114 a negative low potential portion with attenuated potential, and there is formed an electrostatic latent image consisting of the low potential portion and the high potential portion obtained through the initialization.

In the developing unit 136, a non-magnetic toner is stored so as to substantially fill a developing container 118, and a toner agitating member 144 is arranged so as to be buried under the toner; in the lowermost portion, a toner supply roller 145 formed of a sponge material is held in press contact with a developing roller 143. A developing blade 146 in the form of a plate spring is held in press contact with the upper right portion of the developing roller 143.

(Description of the Operation of the Image Forming Apparatus)

The operation of the above-described image forming apparatus will be briefly described with reference to FIGS. 13 and 14. First, when a power source is turned on and instructions on the property and number of the sheets to be used, printing mode and the like are input through keys or as signals from a host apparatus connected to the image forming apparatus, one of the sheets accommodated in the sheet cassette 104 is supplied to the registration roller pair 124 by way of the sheet feeding roller 126. The rotation of the registration roller pair 124 is temporarily stopped, and the conveyance of the sheet is on standby with the leading end of the sheet abutting the nip portion defined by the registration roller pair 124.

Subsequently, the driving roller 112 rotates counterclockwise, and the driven roller 113 also rotates counterclockwise, whereby the entire belt 111 circulates counterclockwise, with its upper portion in contact with the four photosensitive drums 114.

At the same time, the developing containers 118 and the photosensitive drums 114 are successively driven in synchronism with printing. The photosensitive drums 114 rotate clockwise, and the charging rollers 116 impart a uniform high negative charge to the peripheral surfaces of the photosensitive drums 114; the scanner 117 performs exposure on the peripheral surfaces of the photosensitive drums 114 in accordance with an image signal to form low potential portions, whereby electrostatic latent images are formed which consist of high negative potential portions due to initialization and low negative potential portions due to exposure. The developing rollers 143 of the developing containers 118 transfers toner to the low potential portions of the electrostatic latent images to thereby form toner images on the peripheral surfaces of the photosensitive drums 114 (reversal development).

As the forward end of the toner image on the peripheral surface of the upstream-end photosensitive drum 114*a* approaches an opposite portion of the belt 111, the registration roller pair 124 starts rotation such that the printing start position of the sheet is matched with the opposite portion, and the sheet is fed to the sheet inlet portion.

The driven roller 113 and an attraction roller (not shown) convey the sheet while holding it with the belt 111. The sheet is attracted by the belt 111 and conveyed to a first transfer portion formed by the photosensitive drum 114*a* and a transfer roller 119*a*.

The transfer rollers 119 (119*a*, 119*b*, 119*c*, and 119*d*) apply transfer current output from a transfer bias power source (not shown) to the sheet through the belt 111. By the transfer current applied from the transfer rollers 119, the toner images on the photosensitive drums 114 are transferred to the sheet.

The sheet to which the toner images in four colors have been transferred is separated from the belt 111 and is conveyed to a fixing apparatus 128. The fixing apparatus 128 fixes the toner images to the sheet by heat and pressure. After the image fixation, the sheet is discharged onto a discharge tray 106 by a discharge roller pair 132 with the toner image facing downwards.

However, as shown in FIG. 14, in the process cartridge 134, the toner supply roller 145 is provided in the lowermost portion of the developing unit 136, so that the toner is carried and supplied downward from above, and the stress on the developing unit 136 is rather large, which makes the toner subject to deterioration.

In the developing unit 136, there is provided the developing roller 143 arranged opposite to the photosensitive drum 114, the developing roller 143 carrying and conveying toner on its surface.

The developing roller 143 is opposed to the developing blade 146. The toner supplied onto and carried by the developing roller 143 hits the developing blade 146, whereby the thickness of the toner layer is regulated.

Thus, the toner in the vicinity of the developing blade 146 is under pressure due to the formation of the toner layer. In addition, a large pressure due to compression of the toner in the gravitational direction is applied thereto. As a result, the toner in the vicinity of the developing blade 146 is not circulated, and suffers stress due to the friction with the developing blade 146 and the toner supply roller 145, which makes the toner subject to deterioration.

In view of this, it might be possible to arrange the developing roller 143 above a toner storage chamber. In such a construction, the toner in the vicinity of the developing blade 146 would not undergo compression due to the gravitational action, and the toner would not easily deteriorate.

However, since it is a construction in which toner is supplied upwards from below, it is rather difficult to secure stability in the toner supply to the developing roller 143.

SUMMARY OF THE INVENTION

The present invention has been made in view of the problem described above in the related art. It is an object of the present invention to provide a developing apparatus in which toner does not easily deteriorate and an image forming apparatus equipped with such a developing apparatus.

Another object of the present invention is to provide a developing apparatus in which toner does not easily deteriorate and in which toner is supplied to a developing roller in a stable manner and an image forming apparatus equipped with such a developing apparatus.

Still another object of the present invention is to provide a developing apparatus including:

a housing;

a developer bearing member rotatably provided at an opening of the housing;

a developer containing room;

a carrying member for carrying the developer in developer containing room toward the developer bearing member; and a developer accumulating portion arranged near the developer bearing member and adapted to accumulate the developer carried by the carrying member, wherein the developer accumulating portion is provided above a rotational center of the carrying member.

Still another object of the present invention is to provide an image forming apparatus including:

an image bearing member;

developing means for developing an electrostatic latent image formed on the image bearing member; and transfer means for transferring a developer image on the image bearing member to a recording material, the transfer means being arranged above the image bearing member, wherein the developing means includes:

a housing;

a developer bearing member rotatably provided at an opening of the housing;

a developer containing room;

a carrying member for carrying the developer in developer containing room toward the developer bearing member; and a developer accumulating portion arranged near the developer bearing member and adapted to accumulate the developer carried by the carrying member, wherein the developer accumulating portion is provided above a rotational center of the carrying member.

Further objects of the present invention will become apparent from the following detailed description with reference to the accompanying drawings.

BRIEF DESCRIPTION OF THE DRAWINGS

FIG. 10 is a table showing the relationship between the number of sheets undergoing continuous printing and occurrence of streaks;

DETAILED DESCRIPTION OF THE PREFERRED EMBODIMENTS (First Embodiment)

Figure 1:
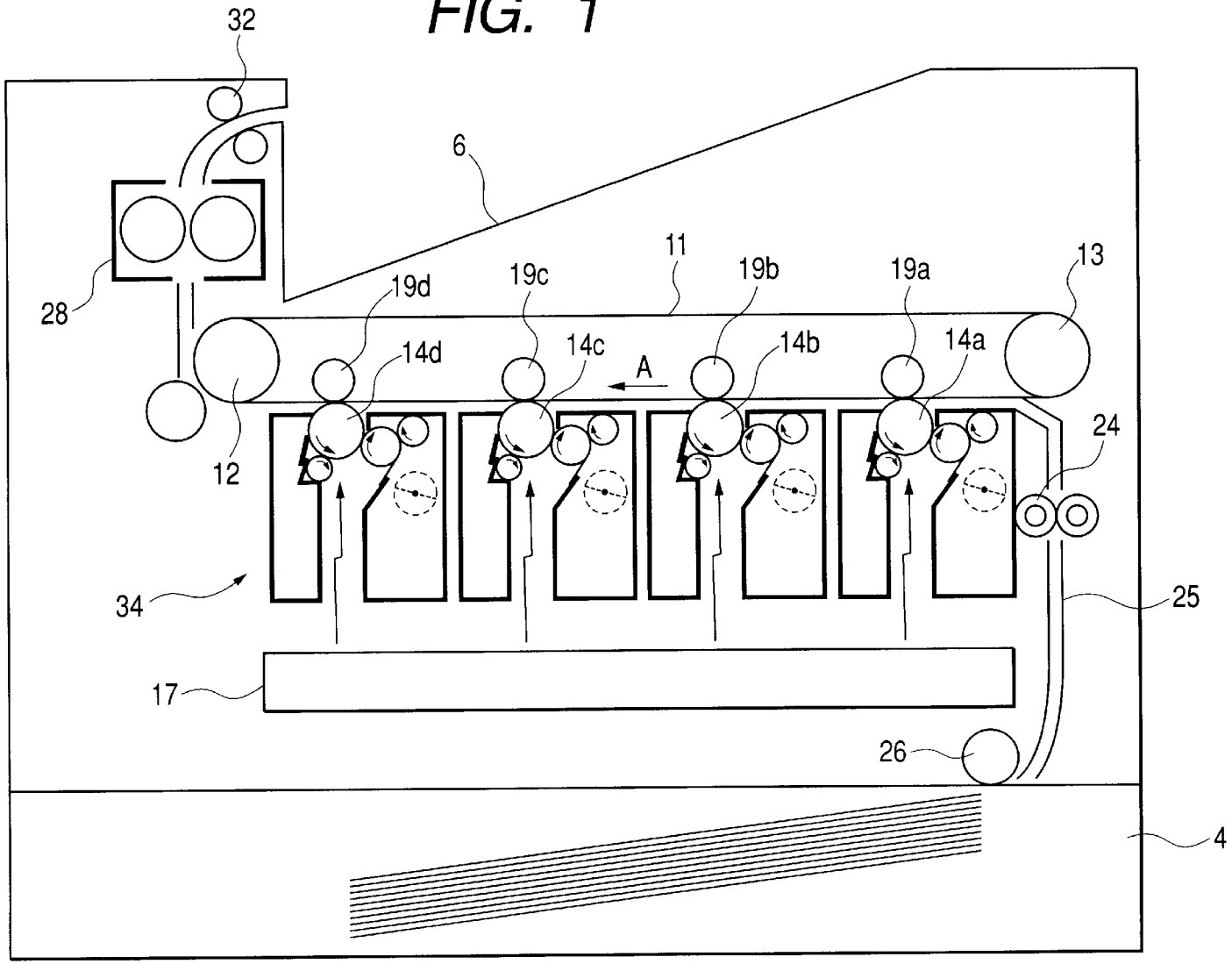
FIG. 1 is a schematic sectional view of an image forming apparatus to which the present invention is applied.
Figure 2:
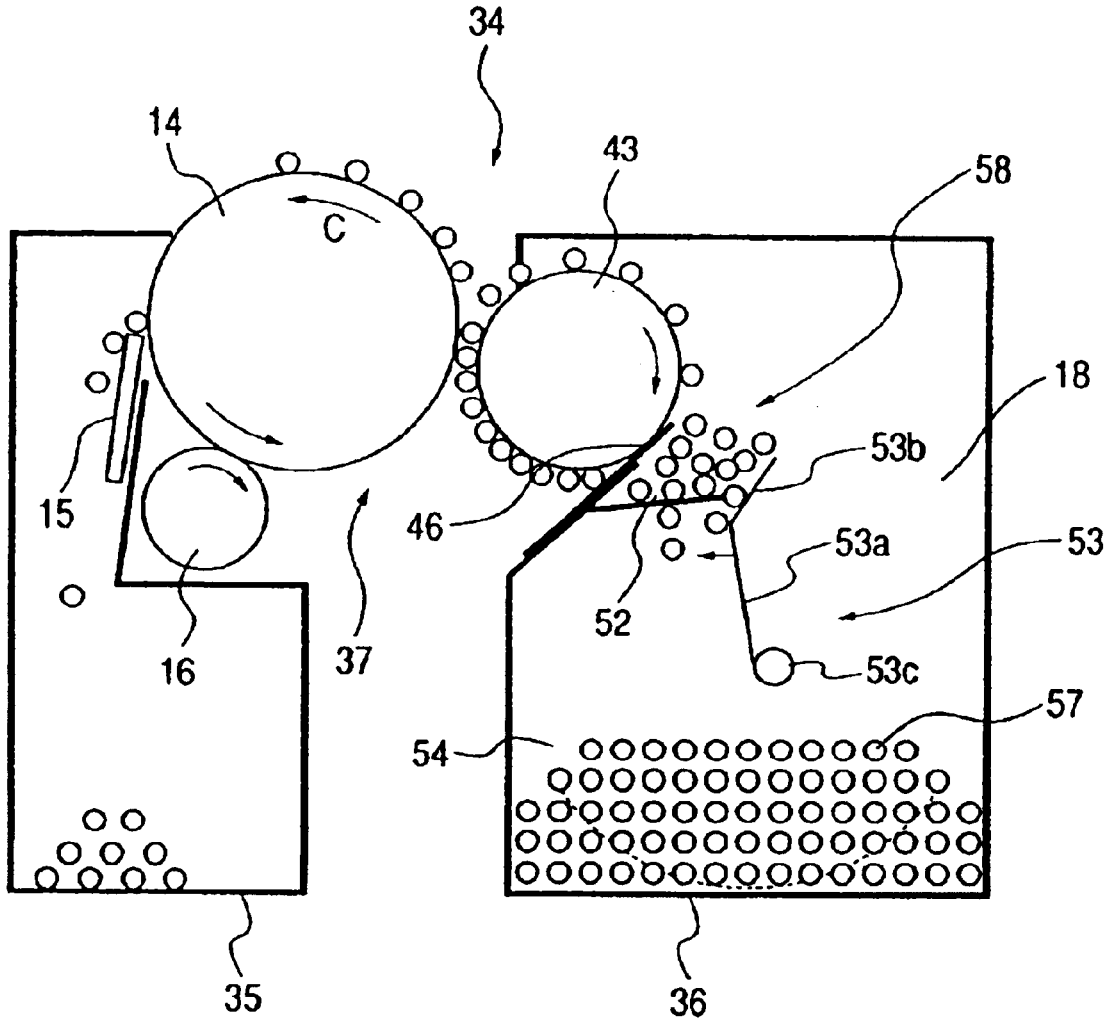
FIG. 2 is a schematic sectional view of a developing apparatus according to a first embodiment.
Figure 3:
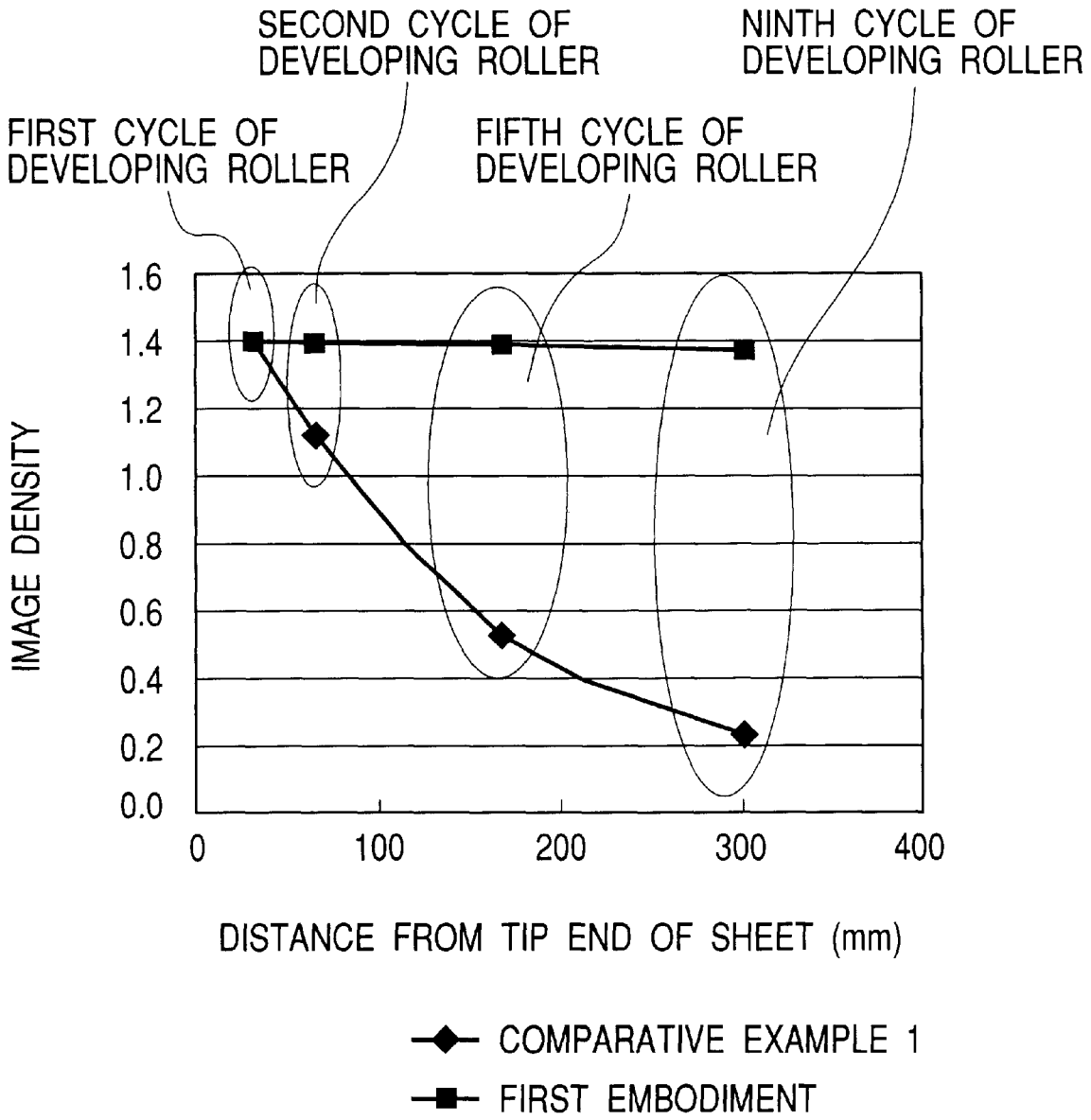
FIG. 3 is a graph showing variation in image density when printing is performed on a sheet.

A first embodiment of the present invention will be described with reference to the drawings. FIG. 1 is a schematic explanatory diagram showing an image forming apparatus, FIG. 2 is an explanatory diagram illustrating a developing apparatus according to the first embodiment, and FIG. 3 is a graph showing variation in image density when printing is performed on a sheet.

(Image Forming Apparatus)

First, an example of an image forming apparatus consisting of a laser beam printer utilizing an electrophotographic process and containing a developing apparatus will be described with reference to FIG. 1.

As shown in FIG. 1, a sheet conveying belt 11 is arranged substantially at the center of the interior of the image forming apparatus. The belt 11, whose end portions are held by a driving roller 12 and a driven roller 13, circulates clockwise as indicated by an arrow A. Under the belt 11, four photosensitive drums 14 (14*a*, 14*b*, 14*c*, and 14*d*) are arranged side by side in a sheet conveying direction (from the right to the left).

On the upstream side of the belt 11 with respect to the sheet conveying direction, there is arranged a registration roller pair 24, and, below it, there is arranged a sheet guiding path 25, at the lower end portion of which a sheet feeding roller 26 is arranged. Below the sheet feeding roller 26, a sheet cassette 4 is arranged.

(Description of Image Forming Process Cartridge)

In the image forming apparatus of FIG. 1, four process cartridges 34 for image formation are arranged side by side, and each process cartridge is detachable with respect to the image forming apparatus main body. FIG. 2 is an enlarged side sectional view of one of the image formation process cartridges 34. The process cartridge 34 shown in FIG. 3 is formed as an integral unit consisting of two sub units: a drum unit 35 and a developing unit 36 serving as a process means acting on the photosensitive drum 14 of the drum unit 35.

The drum unit 35 is equipped with the photosensitive drum 14, a cleaner 15 arranged to the left thereof, and a charging roller 16 arranged below and to the left thereof.

The photosensitive drum 14 consists of a conductive metal roller whose surface is uniformly coated with a photoconductive material; the metal roller portion is grounded and rotates counterclockwise as indicated by an arrow C. As shown in FIG. 1, a scanner 17 for performing exposure on the photosensitive drum 14 is arranged below the process cartridges 34, and light in accordance with image information emitted from the scanner 17 impinges upon the photosensitive drum 14 at the position indicated by reference numeral 37.

The charging roller 16 is connected to a high-voltage power source and applies a blank-state charged potential (initialization potential applied uniformly; in a system it is applied in positive polarity, in another in negative polarity) to the photosensitive drum 14, whereby the photosensitive layer on the peripheral surface of the photosensitive drum 14 is uniformly charged, for example, in negative high potential, and initialized.

The scanner 17 is equipped with a laser light source or an LED light source, and performs selective exposure in accordance with image information on the peripheral surface of the photosensitive drum 14 charged in negative high potential. As a result of this exposure, there is formed on the surface of the photosensitive drum 14 a negative low potential portion with attenuated potential, and there is formed an electrostatic latent image consisting of the low potential portion and the high potential portion obtained through the initialization.

In the developing unit 36, a non-magnetic toner is contained so as to substantially fill a developing container 18, and a toner agitating member 53 serving as a toner carrying means is arranged so as to be buried under the toner; below and to the right of a developing roller 43 serving as a toner carrying member, a developing blade 46 (layer thickness regulating member) in the form of a plate spring is held in press contact with the developing roller 43.

(Description of the Operation of the Image Forming Apparatus)

The operation of the above-described image forming apparatus will be described with reference to FIGS. 1 and 2. First, when a power source is turned on and instructions on the property and number of the sheets to be used, printing mode and the like are input through keys or as signals from a host apparatus connected to the image forming apparatus, one of the sheets accommodated in the sheet cassette 4 is supplied to the registration roller pair 24 by way of the sheet feeding roller 26. The rotation of the registration roller pair 24 is temporarily stopped, and the conveyance of the sheet is on standby with the leading end of the sheet abutting the nip portion defined by registration roller pair 24.

Subsequently, the driving roller 12 rotates clockwise, and the driven roller 13 also rotates clockwise, whereby the entire belt 11 circulates clockwise, with its lower portion in contact with the four photosensitive drums 14.

At the same time, the developing containers 18 and the photosensitive drums 14 are successively driven in synchronism with printing. The photosensitive drums 14 rotate counterclockwise, and the charging rollers 16 impart a uniform high negative charge to the peripheral surfaces of the photosensitive drums 14; the scanner 17 performs exposure on the peripheral surfaces of the photosensitive drums 14 in accordance with an image signal to form low potential portions, whereby latent images are formed which consist of high negative potential portions due to initialization and low negative potential portions due to exposure. The developing rollers 43 of the developing containers 18 transfer toner to the low potential portions of the electrostatic latent images to thereby form toner images on the peripheral surfaces of the photosensitive drums 14 (reversal developing).

As the forward end of the toner image on the peripheral surface of the upstream-end photosensitive drum 14*a* approaches an opposite portion of the belt 11, the registration roller pair 24 starts rotation such that the printing start position of the sheet is matched with the opposite portion, and the sheet is fed to a sheet inlet portion. The sheet fed is attracted by the belt 11, and conveyed to a first transfer portion formed by the photosensitive drum 14*a* and a transfer roller 19*a*.

The transfer rollers 19 (19*a*), 19*b*, 19*c*, and 19*d*) apply transfer current output from a transfer bias power source (not shown) to the sheet through the belt 11. By the transfer current applied from the transfer rollers 19, the toner images on the photosensitive drums 14 are transferred to the sheet.

The sheet to which the toner images in four colors have been transferred is separated from the belt 11 and is conveyed to a fixing apparatus 28. The fixing apparatus 28 fixes the toner images to the sheet by heat and pressure. After the image fixation, the sheet is discharged onto a discharge tray 6 by a discharge roller pair 32 with the toner images facing upward (face-up). It goes without saying that it is possible to provide a discharge path (not shown), enabling the sheet to be discharged with the toner images facing downwards (face-down).

(Description of the Developing Unit)

Next, the developing unit 36 according to the first embodiment will be described with reference to FIGS. 2 and 3. While in this embodiment the developing unit 36 is formed as a sub-unit of the process cartridge 34, this should not be construed restrictively. The developing unit 36 may be formed as an independent developing cartridge. The constructions of the developing unit 36 and the drum unit 35 of this embodiment are suitable for a printer of the type in which the sheet passes above the process cartridge 34.

In FIG. 2, in the lower portion of the developing container 18, there is provided a toner vessel (chamber) 54, which contains a non-magnetic mono-component toner 57. Further, an agitating device or toner agitating member 53, including a paddle 53*a* serving as a toner carrying means, is provided therein so as to be rotatable about a rotational center 53*c*. A thin-plate elastic member 53*b* consisting of Mylar or the like is attached to the forward end of the paddle 53*a*. Further, the developing roller 43 is equipped with a toner accumulating plate member 52 serving as a toner accumulating member and situated under the developing blade 46.

When supplying the toner 57, the paddle 53*a* is rotated, whereby the thin-plate elastic member 53*b* is rotated while being bent to scrape up the toner 57 in the toner vessel 54. In its upper position, the thin-plate elastic member 53*b* is released, and, together with the synergetic effect of its torque, throws the toner 57 onto a toner accumulating portion 58. The toner accumulating plate member 52 is substantially positioned as shown in FIG. 2, and is situated below the position where the developing roller 43 is held in contact with the developing blade 46 and above the rotational center 53*c* of the toner agitating member 53. Due to this positioning, the toner in the vicinity of the developing roller 43 can be supplied to the developing roller 43 after being carried to the toner accumulating portion 58 between the toner accumulating plate member 52 and the developing blade 46 by the paddle 53*a*.

Due to this construction, in which some toner always exists at a toner supply position from which toner is supplied to the developing roller 43, it is possible to stabilize the toner supply to the developing roller 43 while preventing excessive pressure from being applied to the toner in the vicinity of the developing blade 46. The amount of toner supplied onto the developing roller 43 is larger than the requisite amount of toner for development, with substantially no charge being imparted to the toner. This surplus toner is regulated by the developing blade 46 and charged, forming a layer on the developing roller 43 in an amount as required. The charging of the toner is also effected through friction by the rotation of the paddle 53*a*. The toner thus carried onto the developing roller 43 is sent to a development region formed by the developing roller 43 and the photosensitive drum 14, and development is effected in a development electric field.

Next, the effect of the first embodiment will be specifically illustrated.

FIG. 3 shows how density varies on a single sheet in the first embodiment and in a construction with no toner accumulating plate member 52 (comparative example 1) when an A4 size sheet (paper) is passed longitudinally (in the longer-side direction of the A4 size sheet) to effect solid black printing on the entire surface of the sheet.

The developing roller 43 was rotated at a speed that is 150% of the speed of the photosensitive drum 14. In the apparatus used, the photosensitive drum 14 was ϕ30, and the developing roller 43 was ϕ16. The sheet conveying speed of the apparatus was 120 (mm/sec). Thus, when the developing roller 43 makes approximately nine rotations, the printing of an A4 size sheet (length: 297 mm) is completed.

As shown in the graph, in comparative example 1, from the second cycle onwards of the developing roller 43, the density in solid black printing is reduced to an extreme degree. This extreme reduction in density is due to the fact that when solid black printing is effected, the toner on the developing roller 43 is lost as a result of the development on the photosensitive drum 14 using the toner on the developing roller 43, and that there exits no toner on the developing roller 43 until toner is carried to the vicinity of the developing blade 46 through agitation by the paddle 53*a*.

In the first embodiment, in contrast, toner is accumulated on the toner accumulating plate member 52, so that if the toner on the developing roller 43 is consumed, it is always possible to maintain the state in which there is toner in the vicinity of the developing blade 46. Thus, even immediately after the consumption of the toner on the developing roller 43 as a result of solid black printing, it is possible to supply toner onto the developing roller 43. Thus, it is possible to carry toner onto the developing roller 43 over the range from the tip end to the rear end of the sheet, so that there is no reduction in density within the sheet, making it possible to obtain a satisfactory solid image.

Thus, even in the case of a developing unit of the type in which the carrying and supplying of toner onto the developing roller 43 is effected upwardly from below, it is possible to effect development free from a deterioration in toner for a long period of time.

(Second Embodiment)

Figure 4:
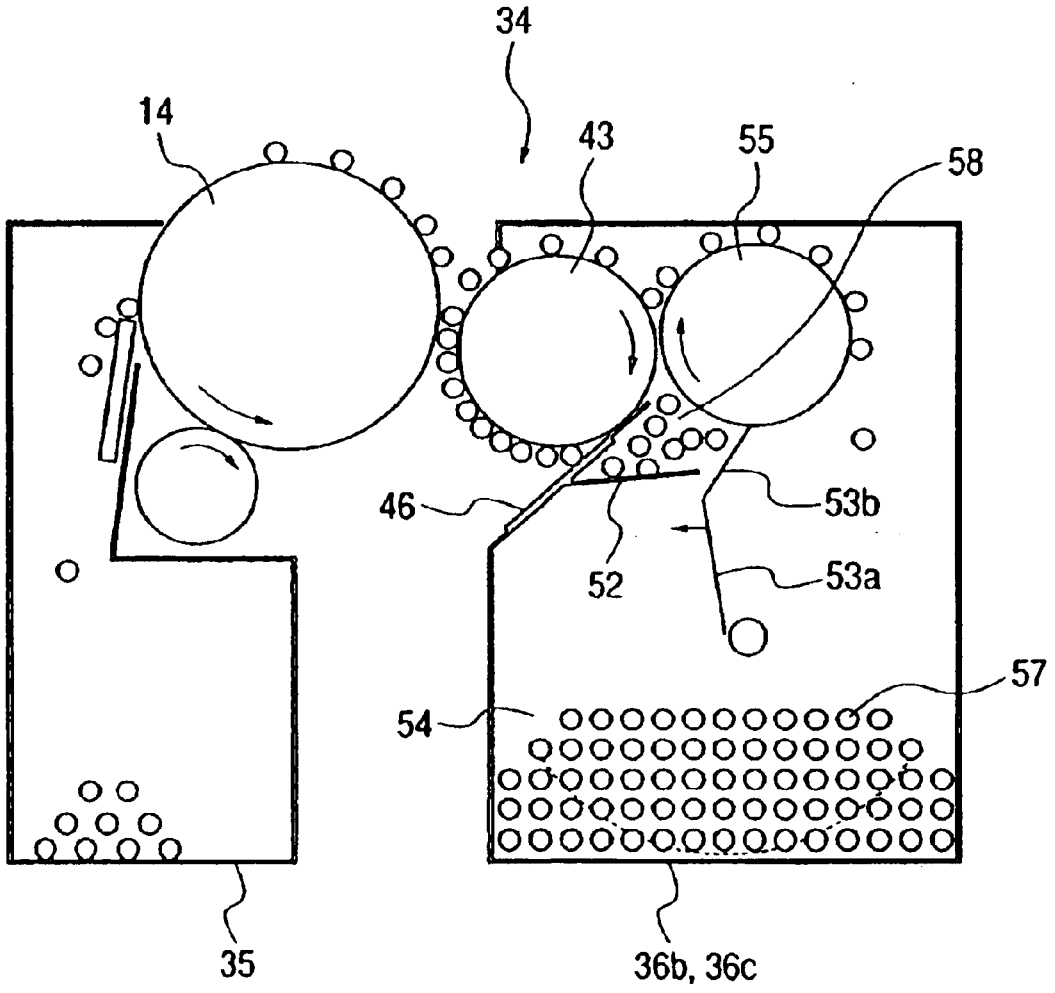
FIG. 4 is a schematic sectional view of a developing apparatus according to second and third embodiments.
Figure 5:
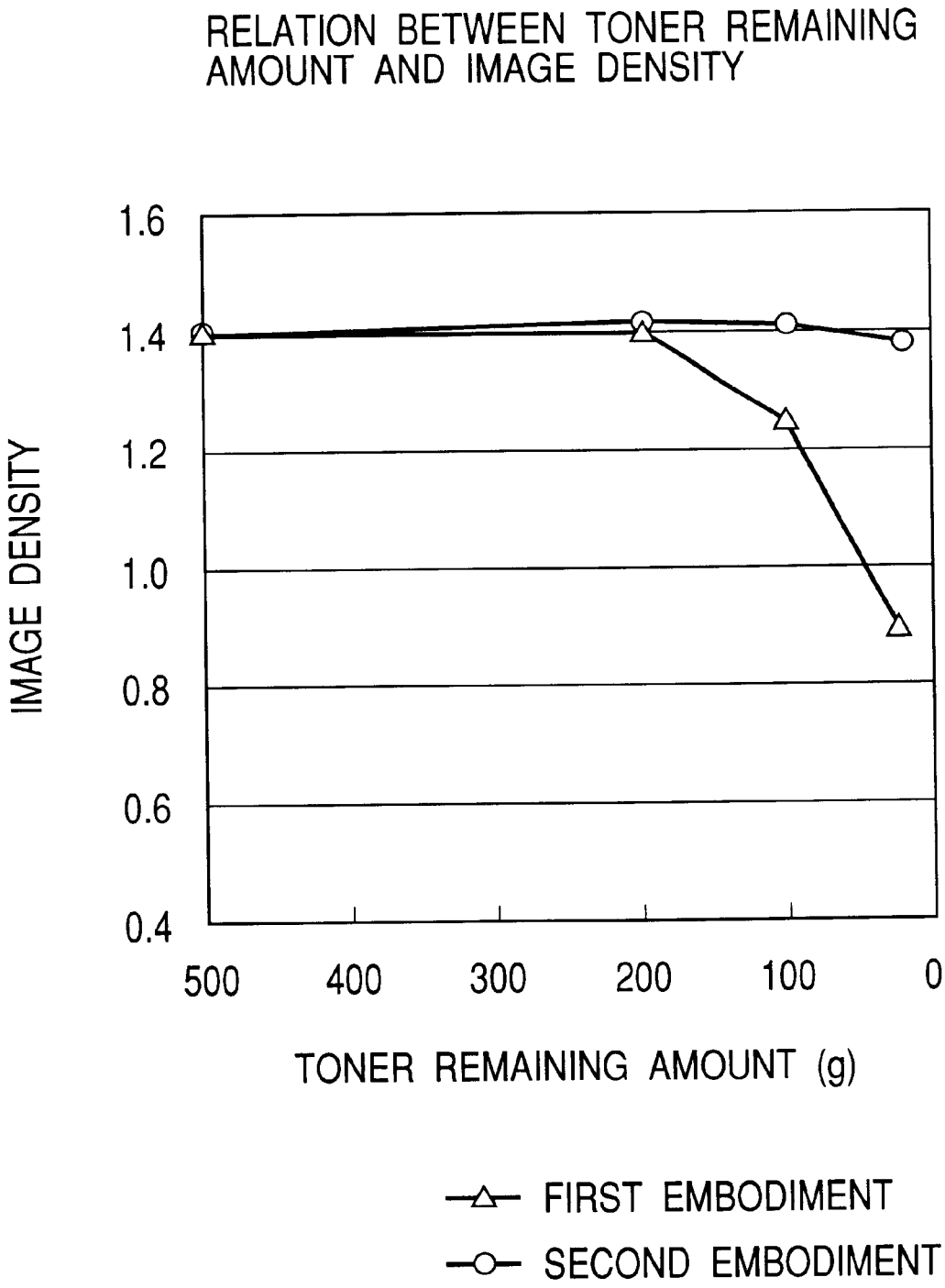
FIG. 5 is a graph showing the relationship between toner remaining amount and image density.

Next, a second embodiment of the present invention will be described in detail. The components that are the same as those of the first embodiment are indicated by the same reference numerals, and a description of such components will be omitted. FIG. 4 is an explanatory drawing showing a developing apparatus according to the second embodiment and a third embodiment (described below). FIG. 5 is a chart showing the relationship between toner remaining amount and image density.

(Description of the Developing Unit)

A developing unit 36*b* according to the second embodiment will be described with reference to FIG. 4. While in this embodiment the developing unit 36*b* is formed as a subunit of the process cartridge 34, this should not be construed restrictively as in the first embodiment. This also applies to the other embodiments described below.

The second embodiment is characterized in that there is provided a member (referred to as a toner supply member 55) for supplying toner 57 accumulated on a toner accumulating plate member 52 onto a developing roller 43. The toner supply member 55 is in the form of a roller made of urethane sponge, which rotates in a non-contact state with respect to the developing roller 43. The toner carried onto a toner accumulating portion 58 by a paddle 53*a* is raised by the rotation of the toner supply member of supply roller 55 and adheres to the surface of the developing roller 43, whereby it is possible to efficiently supply the toner accumulated on the toner accumulating plate member 52 onto the developing roller 43. FIG. 4 is a schematic sectional view showing this construction.

FIG. 5 shows the results of an experiment in which the second embodiment is compared with the first embodiment.

The toner supply member 55 for supplying toner onto the developing roller 43 is formed of an elastic sponge roller of ϕ12. It is not in contact with the developing roller 43, and the gap between the developing roller 43 and the supply roller 55, is 0.5 mm.

In accordance with the second embodiment, due to the toner supply member 55, it is possible to carry toner onto the developing roller 43 in a satisfactory manner, so that it is possible to obtain a satisfactory image in a more stable manner than in the first embodiment. When it is said that a satisfactory image can be obtained, it means that it is possible to maintain a satisfactory image density from the early stage to the end of the service life of the developing unit 36.

As shown in FIG. 5, the initial toner amount is 500 g. As can be seen from the chart, the first embodiment involves a reduction in image density when the remaining toner amount becomes approximately 100 g. In contrast, in the second embodiment, it is possible to achieve a satisfactory image density even when the remaining toner amount has been reduced to a level lower than that of the first embodiment. This is due to the fact that, in the second embodiment, the toner supply member 55 positively supplies the toner accumulated on the toner accumulating plate member 52 onto the developing roller 43.

(Third Embodiment)

Figure 6:
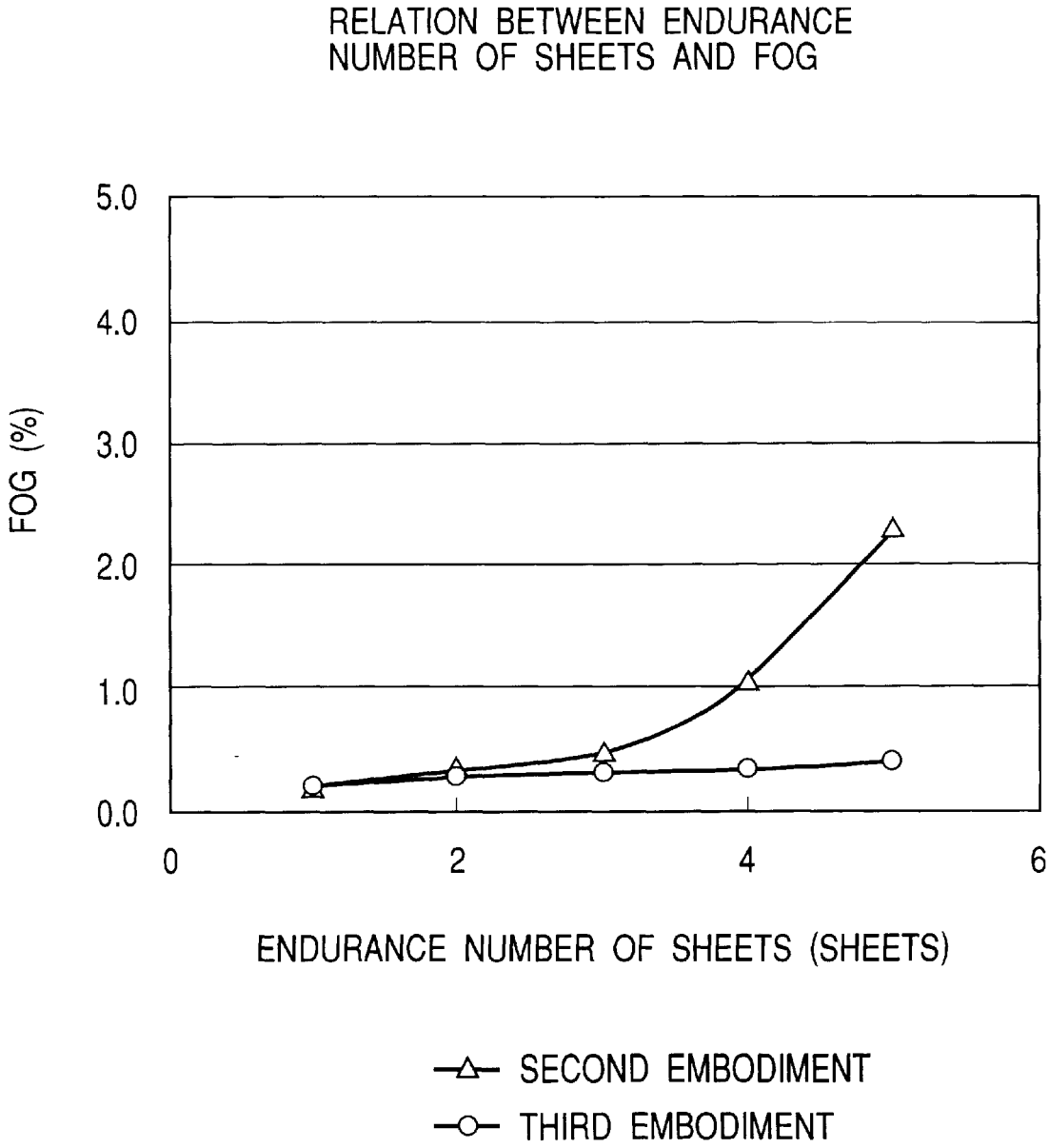
FIG. 6 is a graph showing the relationship between the number of sheets undergoing continuous printing and fog.

Next, a third embodiment of the present invention will be described. The components that are the same as those of the above-described embodiments are indicated by the same reference numerals and a description of such components will be omitted. Since a developing unit 36*c* of the third embodiment exhibits the same sectional configuration as that of the second embodiment, FIG. 4 will be referred to in the following description. FIG. 6 is a chart showing the relationship between endurance number of sheets and fog in the third and second embodiments.

(Description of the Developing Unit)

The developing unit 36*c* according to the third embodiment will be described with reference to FIGS. 4 and 6.

The third embodiment is characterized in that the toner supply member 55 in the second embodiment is in contact with the developing roller 43. Thus, the toner supply member 55 in the third embodiment not only supplies toner onto the developing roller 43, but also functions so as to take away the toner on the developing roller 43 remaining thereon without being used in the development on the photosensitive drum 14 after passing a development region opposed to the photosensitive drum 14; by taking away the toner on the developing roller 43, it refreshes the developing roller 43.

As in the case in which the image forming apparatus forms a lot of images at a low printing ratio, if of the toner on the developing roller 43 having passed the developing blade 46, the amount of toner adhering to the photosensitive drum 14 is small, it is possible in this embodiment to take away a lot of toner on the developing roller 43 which has not been used for development to thereby refresh the developing roller 43. Further, it is possible, over a long period of time, to reduce the stress on the toner due to the contact and friction with the developing blade 46 and the photosensitive drum 14.

FIG. 6 shows the results of an experiment in which the developing unit 36*c* of the third embodiment and the developing unit 36*b* of the second embodiment were compared with each other. In the experiment, the fog on the photosensitive drum 14 when a text image of a low printing ratio of 2% was continuously printed was measured.

To measure the fog on the photosensitive drum 14, the drum rotation was forcibly stopped during the image formation of low printing ratio and taping was effected on the photosensitive drum 14 at that time. And the difference in reflectance before and after the taping was obtained. For the taping, a mending tape manufactured by Sumitomo Three M, Co. was used. For the measurement of reflectance, a Densitometer manufactured by Tokyo Denshoku, Co. was used.

In the second embodiment, the fog on the photosensitive drum 14 was increased throughout the endurance test, whereas, in the third embodiment, there was little generation of fog throughout the endurance test. When the fog on the photosensitive drum 14 is not more than 2%, the image on the sheet is not contaminated and no problem is involved. According to the third embodiment, even in a severe condition of use for the developing unit 36*c*, that is, even when image formation is repeated at low printing ratio, it is possible to obtain a satisfactory image free from fog.

This is due to the fact that the toner supply member 55 in contact with the developing roller 43 takes away the remaining toner on the developing roller 43 while supplying toner onto the developing roller 43. Thus, if image formation is repeated at a low printing ratio, it is possible to prevent the toner on the developing roller 43 being subjected to stress as a result of being continuously rubbed by the developing blade 46 and the photosensitive drum 14.

In the second embodiment, the reason for the increase in fog in the latter half of the endurance test is that when the toner is subjected to stress for a long period of time, the extraneous additive on the toner surface is separated or buried under the toner, with the result that the charging performance and fluidity of the toner change.

(Fourth Embodiment)

Figure 7:
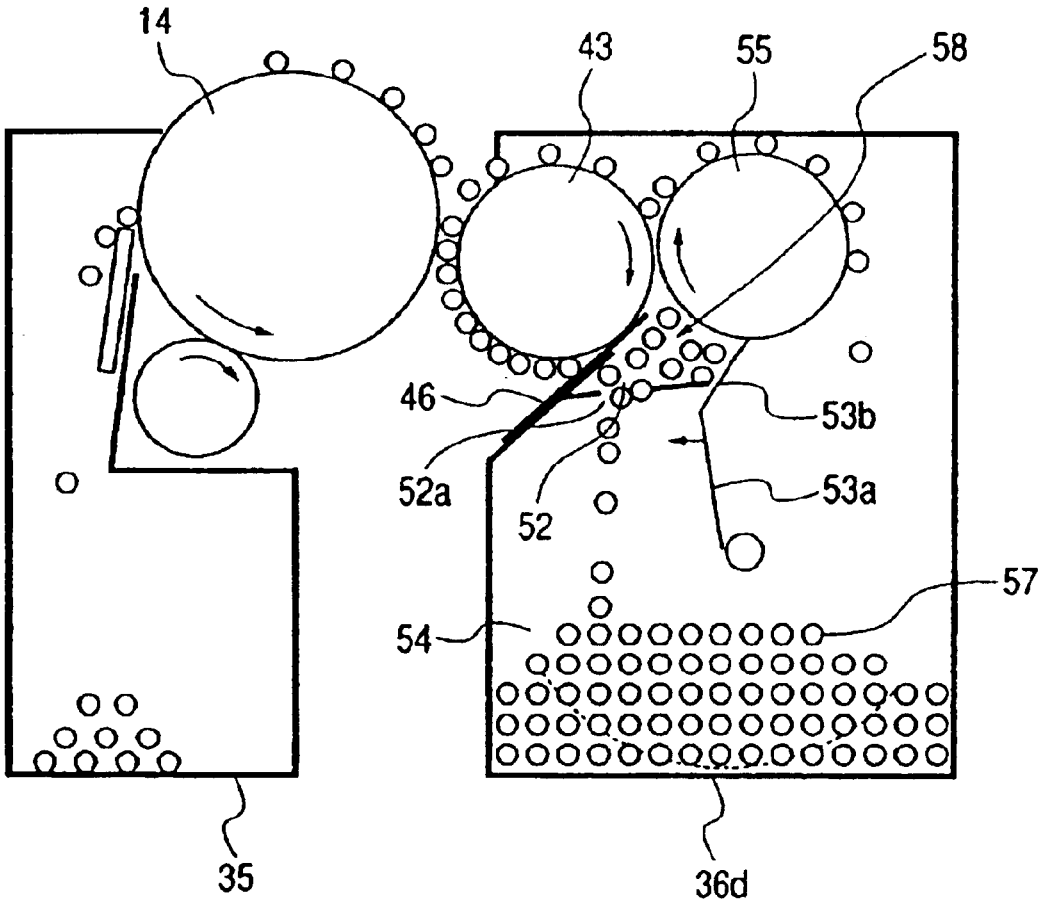
FIG. 7 is a schematic sectional view of a developing apparatus according to a fourth embodiment.
Figure 8:
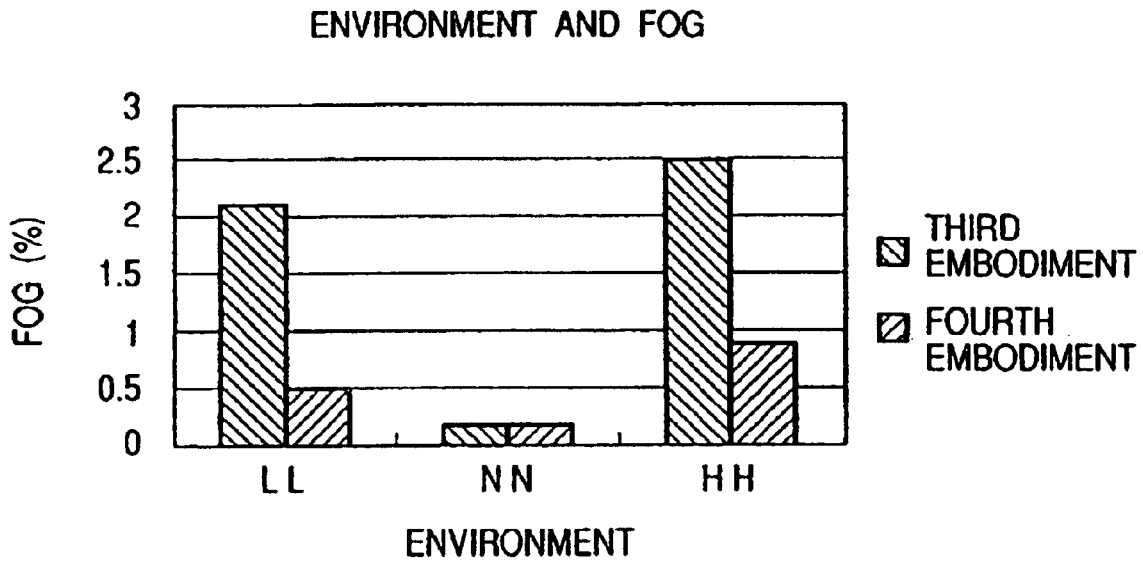
FIG. 8 is a graph showing the relationship between environment and fog.

Next, a fourth embodiment of the present invention will be described in detail. The components, which are the same as those of the above-described embodiments are indicated by the same reference numerals, and a description of such components will be omitted. FIG. 7 is an explanatory drawing showing a developing unit 36*d* according to the fourth embodiment. FIG. 8 is a graph showing the relationship between environment and fog in the fourth and third embodiments.

(Description of the Developing Unit)

The developing unit 36*d* according to the fourth embodiment will be described with reference to FIGS. 7 and 8.

As shown in FIG. 7, the fourth embodiment is characterized in that an opening 52*a* is provided in the toner accumulating plate member 52. Otherwise, it is the same as the third embodiment. Due to this construction, some of the toner accumulated on the toner accumulating plate member 52 passes through the opening 52*a*, and it is possible to prevent excessive toner from being accumulated on the toner accumulating plate member 52, so that, when the toner has reached the requisite amount, the surplus toner can be returned to the toner vessel 54 through the opening 52*a*, whereby it is possible to control to an appropriate level the amount of toner accumulating in the toner accumulating portion 58 surrounded by the developing blade 46, the developing roller 43, and the toner accumulating plate member 52. Further, since it is always possible to refresh the toner existing in the toner accumulating portion 58, it is possible to perform a satisfactory development.

Further, when toner is accumulated on the toner accumulating plate member 52, the toner pressure in the toner accumulating portion 58 gradually increases. Due to this toner pressure, the pressure with which the developing blade 46 is held in contact with the developing roller 43 can vary. The toner undergoes friction charging as it passes between the developing blade 46 and the developing roller 43 while being rubbed thereby. Thus, when the toner pressure with respect to the developing blade 46 is unstable, the toner charging is also likely to become unstable.

In particular, in a high-temperature/high-humidity environment (32.5-C. and 80% RH; hereinafter referred to as HH) and in a low-temperature/low-humidity environment (10-C. and 20% RH; hereinafter referred to as LL), the toner charging is more likely to become unstable as compared with a normal-temperature/normal-humidity environment (23-C. and 50% RH) hereinafter referred to as NN. When, in such an environment, the toner pressure with respect to the developing blade 46 is unstable, the toner charging becomes further unstable.

FIG. 8 shows the results of comparison of the third embodiment and the fourth embodiment in terms of the fog on the photosensitive drum 14 in NN environment, HH environment, and LL environment. The fog measurement was performed in the same manner as described in relation to the third embodiment.

As shown in FIG. 8, the developing unit 36*d* of the fourth embodiment involves less fog than the developing unit 36*c* of the third embodiment in any of NN environment, HH environment, and LL environment, which means the developing unit 36*d* of the fourth embodiment is capable of performing image formation in a more stable manner.

(Fifth Embodiment)

Figure 9:
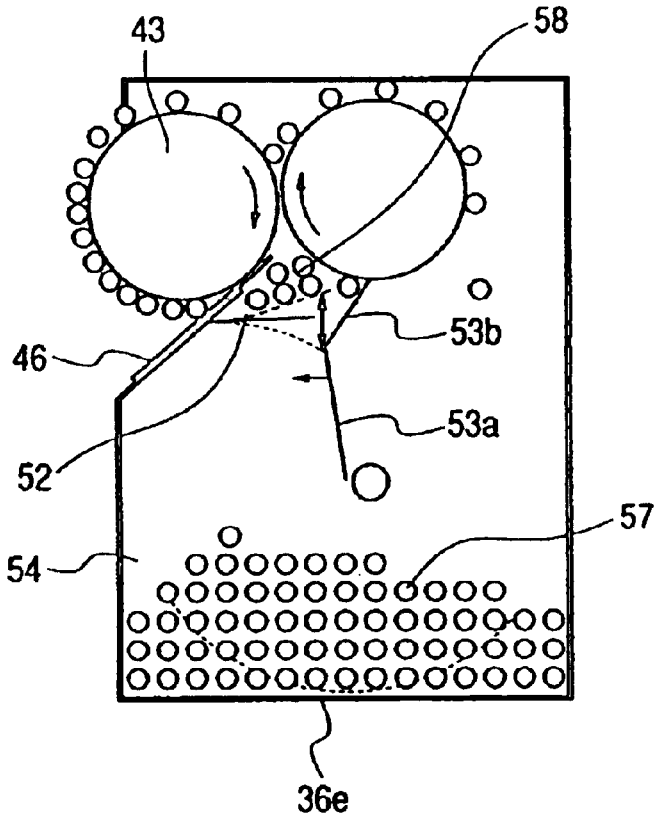
FIG. 9 is a schematic sectional view of a developing apparatus according to a fifth embodiment.

Next, a fifth embodiment of the present invention will be described in detail. The components that are the same as those of the above-described embodiments are indicated by the same reference numerals and a description of such components will be omitted. FIG. 9 is an explanatory drawing showing a developing unit 36*e* of the fifth embodiment, and FIG. 10 is a table showing the relationship between print number of sheets and occurrence of streak when an image of low printing ratio is continuously printed by using the fifth embodiment and the third embodiment.

(Description of the Developing Unit)

The developing unit 36*e* according to the fifth embodiment will be described with reference to FIGS. 9 and 10.

As shown in FIG. 9, the fifth embodiment is characterized in that the toner accumulating plate member 52 is flexible. By making the toner accumulating plate member 52 flexible, it is possible to prevent blocking of the toner accumulated in the toner accumulating portion 58.

The toner accumulating plate member 52 vibrates when the developing roller 43 and the photosensitive drum 14 rotate and vibrate and when the paddle 53*a* comes into direct contact with the toner accumulating plate member 52. As a result, the surplus toner accumulating in the toner accumulating portion 58 is released. Thus, if the fluidity of the toner is reduced in HH environment, it is possible to prevent blocking of the toner accumulated in the toner accumulating portion 58.

When blocking occurs in the toner accumulating portion 58, the toner is allowed to fuse starting from the forward end of the developing blade 46. When toner is fused to the developing blade 46, a satisfactory layer formation cannot be effected, and there is the danger of streak occurring in a halftone image.

In the portion where toner is fused to the developing blade 46, it is impossible for the toner layer to be thin and uniform. Thus, unevenness in density is generated in a halftone image, and appears as a streak. In the case of a character image, this streak is generated especially when severe fusion occurs.

FIG. 10 shows the results of evaluation of streak occurrence in halftone and character images in HH environment in the fifth embodiment and the third embodiment. In the evaluation, continuous printing of low printing ratio was first performed in HH environment in order to create a state in which blocking is likely to occur in the toner accumulating portion 58, and then halftone and character images were formed for visual evaluation of streak level. In FIG. 10, symbol O indicates no streak generation; symbol indicates an acceptable level of streak; and symbol × indicates a bad streak level.

It can be seen from FIG. 10 that, in the third embodiment, when the print number of sheets at low printing ratio in HH environment increases, a streak is likely to be generated in a halftone image, and that, in the fifth embodiment, no streak is generated if continuous printing is conducted at low printing ratio. For example, a mechanism is adopted in which the toner accumulating plate member 52 consists of a Mylar member and in which when a pressure not less than a fixed level is applied to the toner accumulating portion 58, the Mylar is deflected, causing toner to fall.

Thus, when the amount of toner accumulated in the vicinity of the toner accumulating member 52 has reached the requisite level, a partition member is deflected to return toner to the toner vessel 54, whereby it is possible to control the amount of toner accumulated in the toner accumulating portion 58 surrounded by the developing blade 46, the developing roller 43, and the toner accumulating plate member 52.

(Sixth Embodiment)

Figure 11:
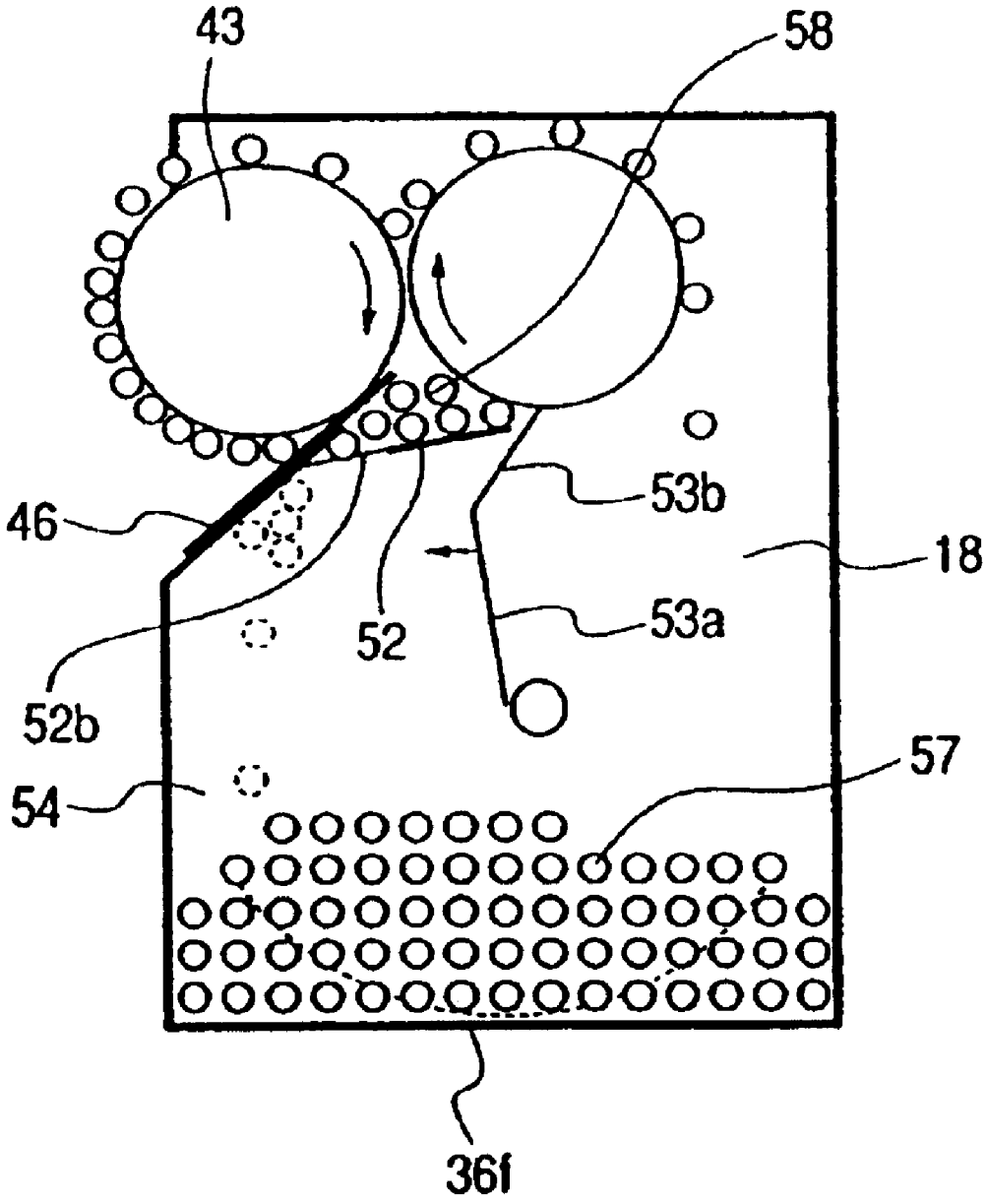
FIG. 11 is a schematic sectional view of a developing apparatus according to a sixth embodiment.
Figure 12:
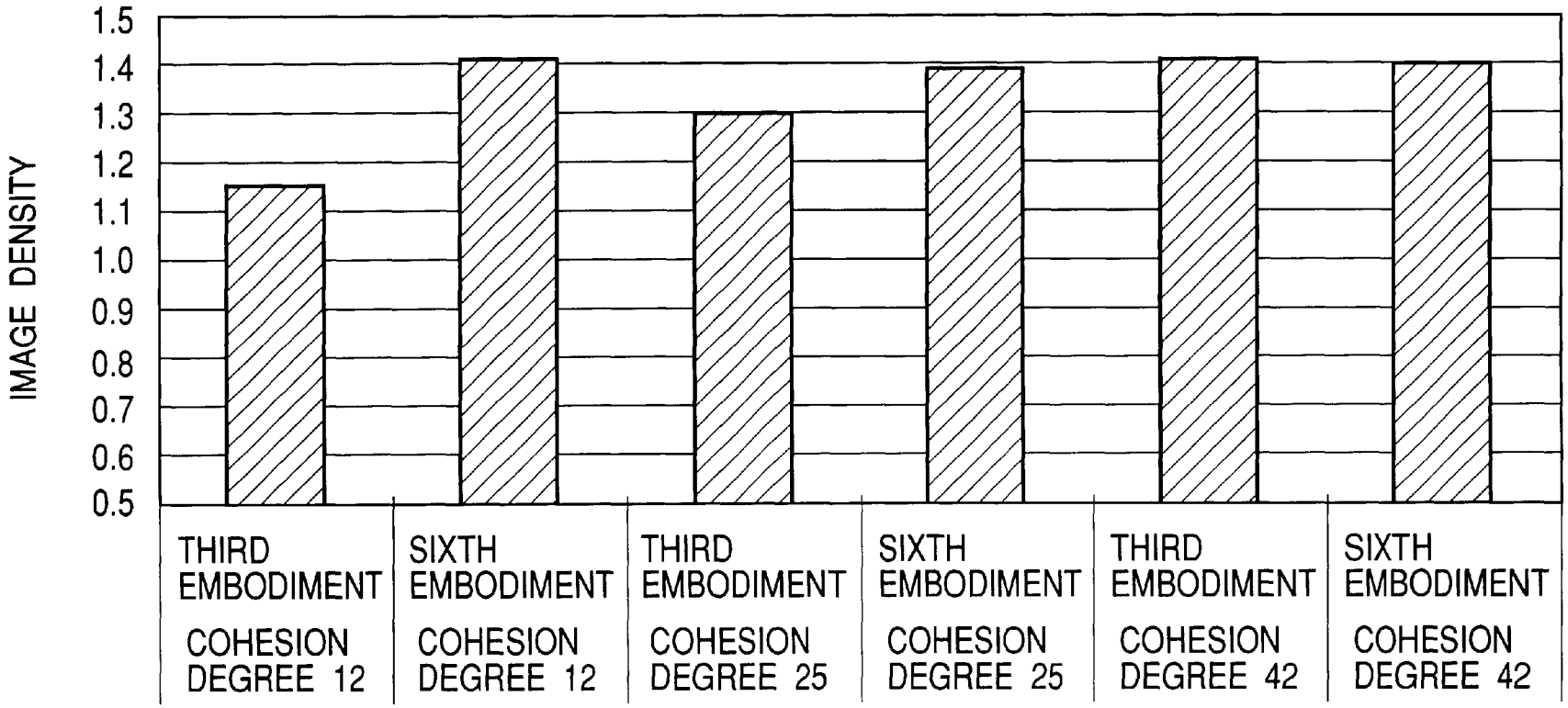
FIG. 12 is a graph showing the relationship between toner cohesion degree and image density.
Figure 13:
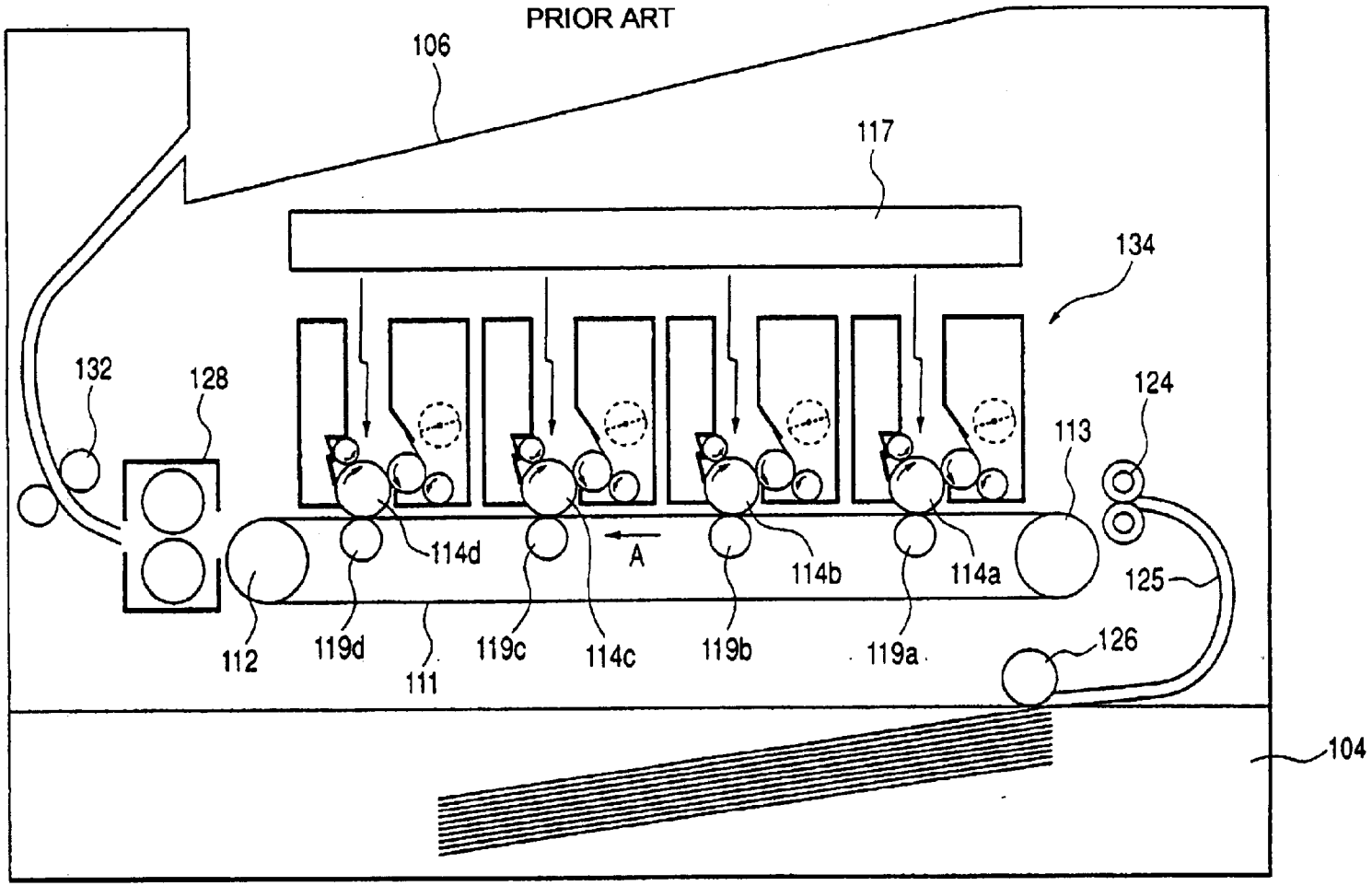
FIG. 13 PRIOR ART
FIG. 13 is a schematic sectional view of a printer serving as a help to understand the present invention.
Figure 14:
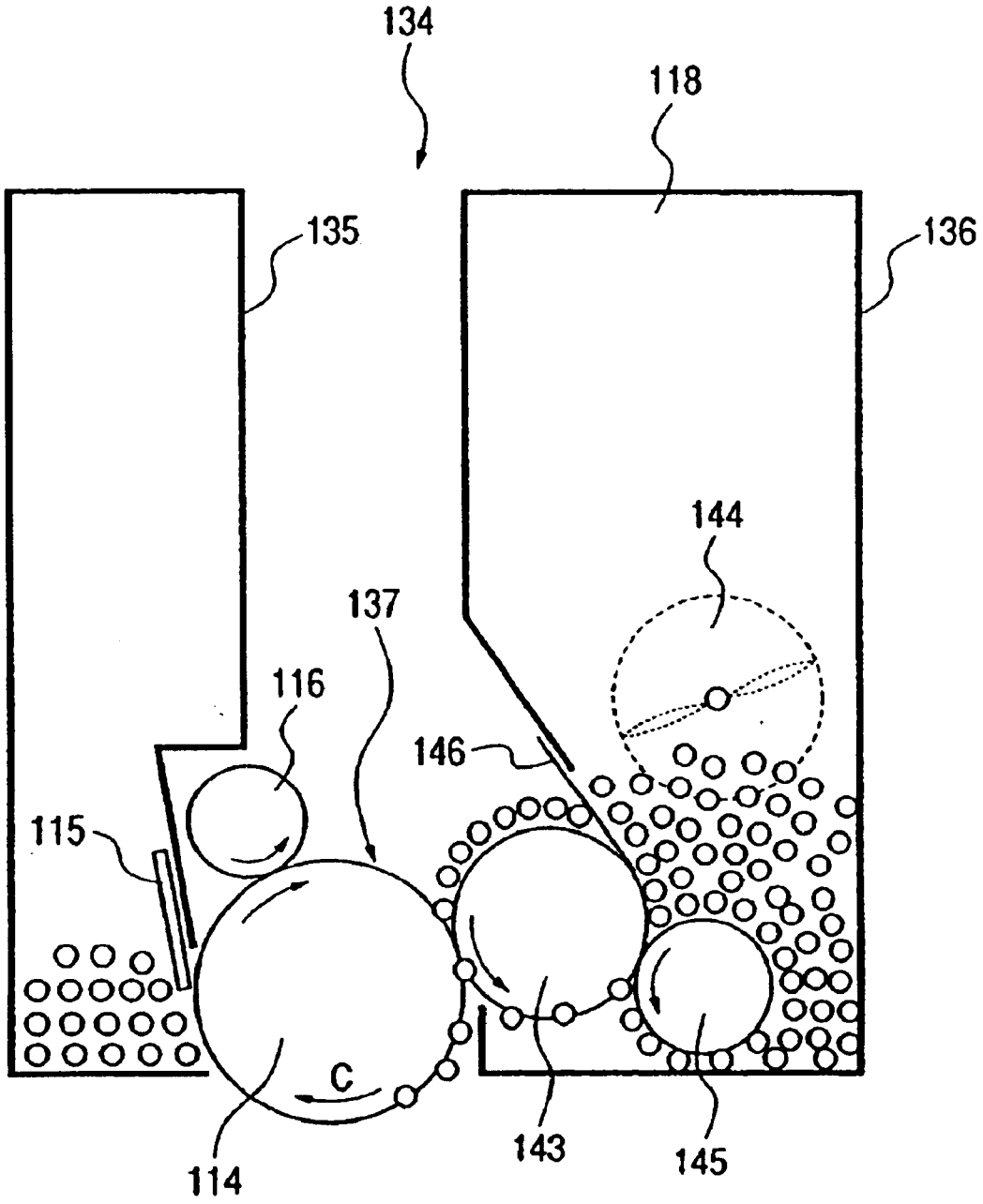
FIG. 14 PRIOR ART
FIG. 14 is a schematic sectional view of a process cartridge serving as a help to understand the present invention.

Next, a sixth embodiment of the present invention will be described in detail. The components that are the same as those of the above-described embodiments are indicated by the same reference numerals, and a description of such components will be omitted. FIG. 11 is an explanatory drawing showing a developing unit 36*f* according to the sixth embodiment. FIG. 12 is a graph showing the relationship between toner cohesion degree and image density in the sixth and third embodiments.

(Description of the Developing Unit)

The developing unit 36*f* according to the sixth embodiment will be described with reference to FIGS. 11 and 12.

As shown in FIG. 11, the sixth embodiment is characterized in that the toner accumulating plate member 52 has an opening 52*b* equipped with an opening/closing valve, whereby, even when a toner of good fluidity is used, it is possible to accumulate toner on the toner accumulating plate member 52, and to maintain the toner pressure in the toner accumulating portion 58 at an appropriate level.

FIG. 12 shows the results of comparison in image density when toners differing in fluidity are used in the constructions of the sixth embodiment and the third embodiment. Here, cohesion degree is used as the index of toner fluidity. The smaller the value of cohesion degree is, the better the toner fluidity becomes. The cohesion degree measurement was performed as follows.

First, 2*g* of toner passed through a sieve of 200 meshes was obtained. Then, sieves of 60 mesh, 100 mesh, and 200 mesh were stacked together in that order from above in a powder tester (manufactured by Hosokawa Micron, Co.), and the 2*g* of specimen obtained was gently put on the set of sieves and a vibration of an amplitude of 1 mm was imparted thereto for 65 seconds. And the weight of the magnetic iron oxide remaining on each sieve was measured to calculate the cohesion degree by the following equation:

Cohesion degree=(the weight of the specimen remaining on the 60 mesh sieve)/(the weight of the specimen put on the sieve set)×100+(the weight of the specimen remaining on the 100 mesh sieve×3/5)/(the weight of the specimen put on the sieve set)×100+(the weight of the specimen remaining on the 200 mesh sieve×1/5)/(the weight of the specimen put on the sieve set)×100.

It can be seen from FIG. 12 that, in the third embodiment, a reduction in image density is to be observed with toners of small cohesion degree value, i.e., of good fluidity. This is due to the fact that a toner of good fluidity is caused to fall by the gravitational force onto the toner vessel 54 of the developing container 18 through the opening 52*b,* so that toner is not easily accumulated on the toner accumulating plate member 52.

In the sixth embodiment, in contrast, it is possible to obtain a satisfactory image density even with a toner of a small cohesion degree value, i.e., of good fluidity. This is due to the fact that the opening 52*b* of the toner accumulating plate 52 remains closed until the requisite amount of toner is accumulated and that when excessive toner is going to be accumulated, the Mylar (valve) is automatically deflected downwards due to the toner pressure in the toner accumulating portion 58, and toner is allowed to fall. Thus, even with a toner of good fluidity, it is always possible to achieve a satisfactory image density.

(Other Embodiments)

While in the above-described embodiments the image forming apparatus is a four-color printer, this should not be construed restrictively. The image forming apparatus may also be a facsimile apparatus or a copying machine. Further, the image forming apparatus is not restricted to a colored one. It may also be a monochrome one or of a plurality of colors other than four colors.

The present invention is not restricted to the above-described embodiments, and modifications are possible without departing from the technical scope of the invention.

What is claimed is:

1. A developing apparatus comprising:

a housing;

a developer bearing member rotatably provided at an opening of said housing;

a developer containing room;

a carrying member for carrying developer from said developer containing room toward said developer bearing member; and a developer accumulating portion provided proximate to said developer bearing member and adapted to accumulate the developer carried by said carrying member, wherein said developer accumulating portion is provided above a rotational center of said carrying member.

2. A developing apparatus according to claim 1, wherein said carrying member comprises a paddle.

3. A developing apparatus according to claim 1, further comprising a supply member for supplying the developer in said developer accumulating portion to said developer bearing member.

4. A developing apparatus according to claim 3, wherein said supply member is provided so as not to be in contact with said developer bearing member.

5. A developing apparatus according to claim 3, wherein said supply member is provided so as to be in contact with said developer bearing member.

6. A developing apparatus according to claim 1, wherein an opening through which the developer falls is provided in a part of said developer accumulating portion.

7. A developing apparatus according to claim 6, wherein the opening through which the developer falls can be opened and closed by a valve.

8. A developing apparatus according to claim 1, wherein said developer accumulating portion comprises a partition provided in said housing.

9. A developing apparatus according to claim 8, wherein said partition is flexible.

10. A developing apparatus according to claim 1, wherein said developing apparatus is mounted in a cartridge detachably mountable to an image forming apparatus for forming an image on a recording material.

11. An image forming apparatus comprising:

an image bearing member;

developing means for developing an electrostatic latent image formed on said image bearing member; and transfer means for transferring a developer image on said image bearing member to a recording material, said transfer means being arranged above said image bearing member, wherein said developing means includes:

a housing;

a developer bearing member rotatably provided at an opening of said housing;

a developer containing room;

a carrying member for carrying developer from said developer containing room toward said developer bearing member; and a developer accumulating portion provided proximate to near said developer bearing member and adapted to accumulate the developer carried by said carrying member, wherein said developer accumulating portion is provided above a rotational center of said carrying member.

12. An image forming apparatus according to claim 11, wherein said developing means is detachably mountable to a main body of said image forming apparatus.

13. An image forming apparatus according to claim 11, wherein said image bearing member and said developing means constitute a single unit, which is detachably mountable to a main body of said image forming apparatus.

* * * * *

UNITED STATES PATENT AND TRADEMARK OFFICE

CERTIFICATE OF CORRECTION

PATENT NO. : 6,721,527 B2
DATED : April 13, 2004
INVENTOR(S) : Kenji Kanari et al.

It is certified that error appears in the above-identified patent and that said Letters Patent is hereby corrected as shown below:

Column 9,
Line 47, "if" should read -- if, --.

Signed and Sealed this

Seventeenth Day of August, 2004

JON W. DUDAS
*Acting Director of the United States Patent and Trademark Office*